United States Patent [19]

Ferron

[11] Patent Number: 4,499,810

[45] Date of Patent: Feb. 19, 1985

[54] OBTURATOR FOR FLUTE DESIGNED TO IMPROVE THE EMISSION OF CERTAIN NOTES

[76] Inventor: Ernest J. Ferron, 14, rue Massacre, 76000 Rouen, France

[21] Appl. No.: 506,218

[22] Filed: Jun. 21, 1983

[30] Foreign Application Priority Data

Jun. 23, 1982 [FR] France ..... 82 11000

[51] Int. Cl.[3] ..... G10D 7/02

[52] U.S. Cl. ..... 84/384

[58] Field of Search ..... 84/384, 386

[56] References Cited

U.S. PATENT DOCUMENTS

| | | | |
|---|---|---|---|
| 1,013,037 | 12/1911 | Melfi | 84/384 |
| 1,106,249 | 8/1914 | Smenner | 84/386 X |
| 1,802,791 | 4/1931 | Stover | 84/385 |
| 2,530,155 | 11/1950 | DeLuca | 84/383 |
| 2,544,033 | 3/1951 | Lawrence | 84/384 |
| 3,763,737 | 10/1973 | Sandner | 84/384 |
| 4,058,046 | 11/1977 | Fajardo | 84/384 |
| 4,240,320 | 12/1980 | Pellerite | 84/384 |

FOREIGN PATENT DOCUMENTS

| | | |
|---|---|---|
| 59465 | 1/1891 | Fed. Rep. of Germany . |
| 369459 | 1/1907 | France . |
| 540973 | 7/1922 | France . |

OTHER PUBLICATIONS

Musical Acoustics Piano and Wind Instruments by Earle L. Kent Dowden, Hutchinson & Ross, Inc. 1977.

Fundamentals of Musical Acoustics by Arthur H. Benade Oxford University Press, 1976.

The Flute by Philip Bate, W. W. Norton & Company Inc.

Acoustical Aspects of Woodwind Instruments by Cornelis J. Nederveen.

*Primary Examiner*—Lawrence R. Franklin

*Attorney, Agent, or Firm*—Brumbaugh, Graves, Donohue & Raymond

[57] ABSTRACT

The invention relates to an obturator designed to close the cavity provided next to the mouthpiece hole of a flute or similar instrument, which obturator comprises one auxiliary resonator issuing into the column of air and produced in the form of a chamber the length of which can be adjusted to improve the emission of at least one particular note of the instrument.

16 Claims, 10 Drawing Figures

OBTURATOR FOR FLUTE DESIGNED TO IMPROVE THE EMISSION OF CERTAIN NOTES

BACKGROUND OF THE INVENTION

The invention relates to an obturator designed to improve the emission of certain notes of a German flute or similar instrument. It is known that in most wind instruments, there are a number of notes which are difficult because their emission is uncertain from both the attack and stability points of view. This is for example the case with certain low notes of the German flute.

SUMMARY OF THE INVENTION

It is the object of the present invention to propose an obturator which will aid the emission of such notes. This object is reached in that, according to the invention, there is provided inside the obturator, at least one auxiliary resonator issuing into the column of air and designed to form a chamber, the length of which is adjusted, in specific manner, to aid the emission of at least one particular note of the instrument.

Advantageously, the length of the chamber is so adjusted that its own frequency is a binary logarithm of the frequency of the fundamental of said note. In other words, the specific resonator is tuned to a sensitive harmonic (one of the higher octaves) of the fundamental of the note in question. Accordingly, the chamber is advantageously designed as a chamber of variable length, which length is adjusted for tuning. Such adjustment can be fixed, by any means depending of the adjusting means, if a permanent tuning is required; it can on the other hand be unfixed for possible subsequent changes, if only to be adapted to the different pitches used.

According to a first preferred embodiment of the invention, the specific resonator or resonators are constituted by one or more concentric chambers, advantageously adjustable in length.

According to a second preferred embodiment, the obturator is alveolated, the holes constituting the specific resonators.

According to another presentation of the instrument, the obturator comprises an inner piston sliding in adjustable manner inside an annular piston whose front end can be either flat-shaped, or have a convex funnel shape, a concave funnel shape, a staggered-funnel shape, a divergently-truncated shape, or a convergently-truncated shape.

BRIEF DESCRIPTION OF THE DRAWINGS

The invention will be more easily understood on reading the following description with reference to the accompanying drawings, in which.

DESCRIPTION OF THE PREFERRED EMBODIMENT

Figure 1:
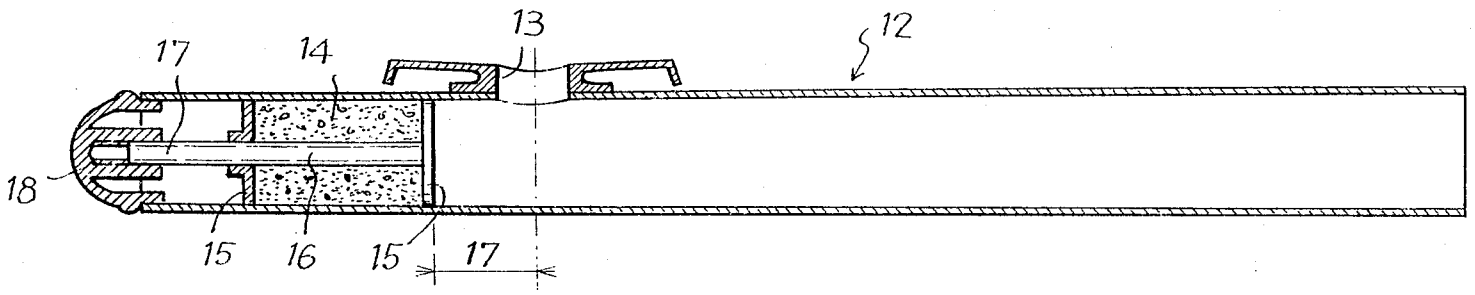
FIG-1 PRIOR ART
FIG. 1 is a longitudinal section of a German flute with a conventional cork stopper.

FIG. 1 shows a flute 12 with its mouthpiece 13 and, on the left of the mouthpiece hole, a cavity conventionally plugged by a cork 14 clamped between two metal plates 15 mounted on a threaded stem 16, the end 17 of which is screwed into a milled knob 18.

In order to form a tight seal, the cork 14 must be force-driven into the conical part of the mouthpiece.

However, since the friction coefficient of the cork 14 is higher than the torque delivered by the milled knob 18, the system does not work in the cavity-extending direction (action of screwing in the knob). The system does not work in the other direction either (action of unscrewing), because even when the knob is released, the volume of the cavity in question is not in any way altered.

According to the invention this fixed stopper is replaced by a system of one or more specific resonators.

Figure 2:
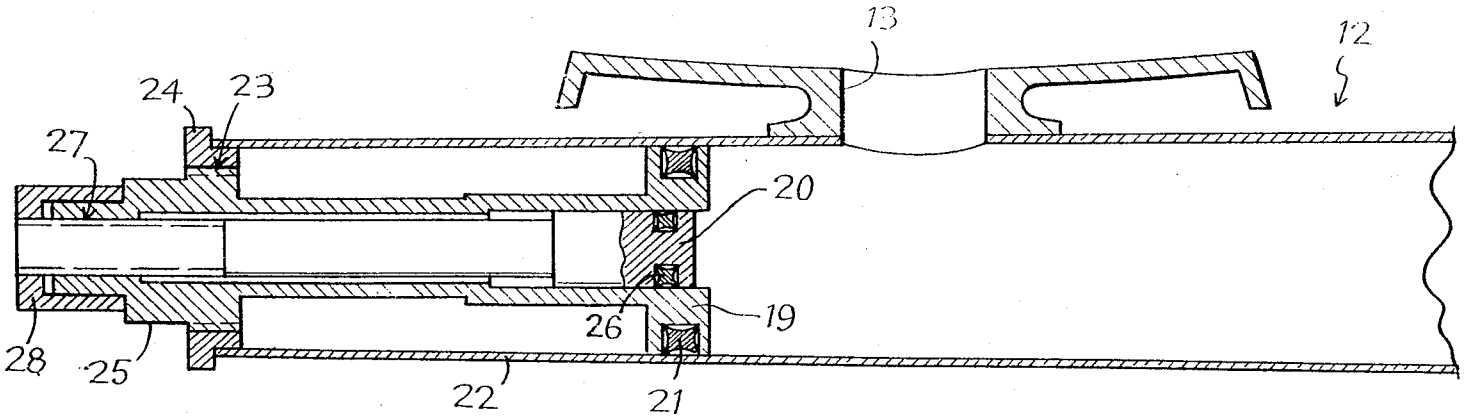
FIG. 2 illustrates a first embodiment of the flute obturator according to the invention.

According to a first embodiment illustrated in FIG. 2, the conventional plug is replaced by an obturator constituted by one or more concentric pistons sliding into one another and, by doing so, forming concentric chambers of adjustable length. FIG. 2 shows only two concentric pistons 19 and 20. The annular piston 19, made tight in 21 by O-rings or by four-lobed joints, can slide into the end 22 of the flute body, its position being adjustable by way of a micrometric thread 23 cooperating with an end flange 24. A surface 25 with two or more flat sides enables one to turn the assembly to adjust its position, whereas a Palmer type vernier, provided on said surface, enables to accurately register the position.

The central piston 20 slides inside annular piston 19 (a tight joint 26 being provided). A micrometric thread 27 cooperates with the rod of annular piston 19 to adjust the relative position of the two pistons: a knob 28 equipped with a Palmer-type vernier permits accurate adjustment.

The emission of low notes, normally difficult on the flute, is greatly improved whilst leaving to the artist much freedom in the frequency field, and giving him a great suppleness of interpretation.

Although it may result in a reduced richness at the level of the specific resonators, with still with a great variety of tones, it is possible to have a fixed annular piston, with only the central piston being movable.

And another possibility is to have more than two concentric pistons.

Figure 3:
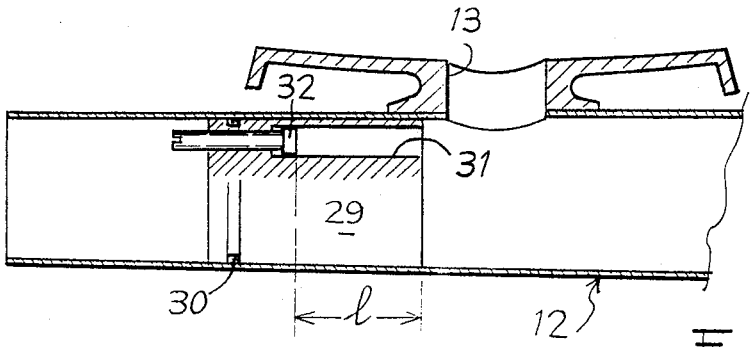
FIG. 3 illustrates a second embodiment of the flute obturator according to the invention.
Figure 4:
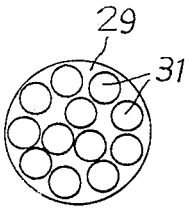
FIGS. 4 and 5 are front views of two variants of the second embodiment illustrated in FIG. 3.
Figure 5:
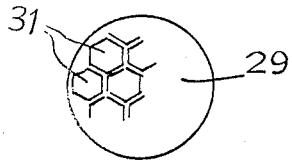

According to another embodiment illustrated in FIGS. 3 and 5, the obturator according to the invention comprises a main obturator 29 mounted with a joint 30 in the end of the flute body, in a fixed position or preferably in a position which is adjustable by means not shown. The main obturator 29 is alveolated with holes 31, which may be cylindrical (FIG. 4), or hexagonal (FIG. 5) or of other shape, and only one of which is illustrated in FIG. 3. The bottom of each hole is composed of an adjustable piston 32 permitting to adjust the length 1 of the hole to a specific frequency in order to improve the emission of a particular note.

In other words, the frequency of each of said holes 31 is carefully tuned with a sensitive harmonic of the fundamental frequencies of the flute.

Thus, instead of only one resonator having an overall function, each note has "its own" resonator 31.

This system further permits, by slightly varying the length of the resonators 31, to individually tune, within certain limits, the tone with the octave ratios of each note of the flute.

For cheaper learning instruments, the length of the resonators 31 may be fixed, in which case the instrument is built in only one pitch, and, the plug 29 can even be made of molded plastics, the holes 31 being then molded to a predetermined length.

This particular embodiment, compared with the preceding one gives a greater fixity of the notes which will be particularly appreciated by beginners. The confirmed artists may prefer the first embodiment which enables a greater personalization of the instrument.

Figure 6:
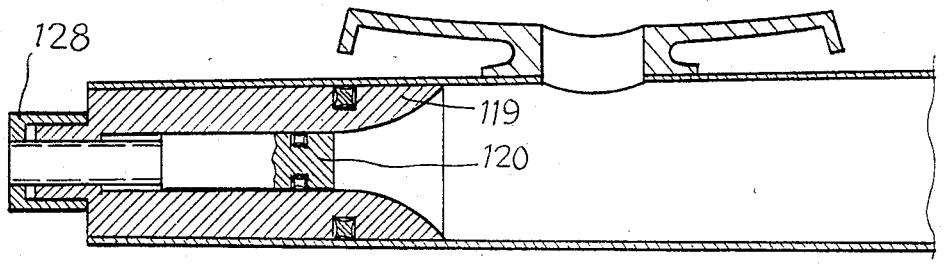
FIG. 6 illustrates a modification of the embodiment shown in FIG. 2, relative to the shape of the annular piston.

FIG. 6 illustrates a variant of the embodiment shown in FIG. 2, wherein an inner piston 120 is slidable inside an annular piston 119, which annular piston may or may not be slidably mounted (as illustrated in FIG. 6). The originality of this variant resides in the convex funnel shape of the front end of the annular piston 119, which resembles the bell of a trumpet. The length of the chamber is tuned to a harmonic of the fundamental note of the flute by means of the movable piston 120 which is adjustable by way of the milled knob 128; experience has shown that the emission, of this fundamental note as well as of the other notes, is made easier. It is just as if, for a given note, other than the fundamental note, the air column had of its own found the right tuning length by "resting" on the area of the funnel-shaped part which corresponds to the right length of the chamber.

Figure 7:
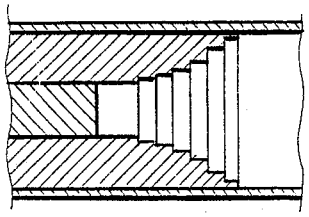
FIGS. 7 to 10 show design variants of the annular piston of FIG. 6.
Figure 8:
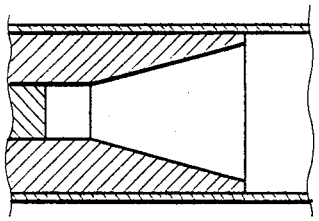
Figure 9:
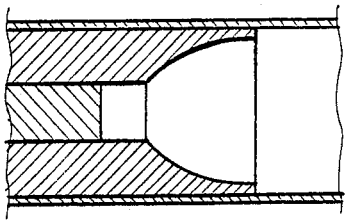
Figure 10:
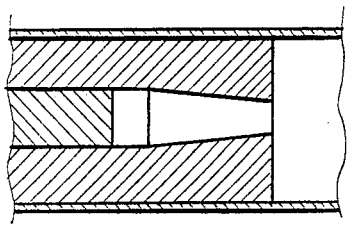

FIGS. 7 to 10 show different shapes which can be given to the front part of piston 119; a staggered convex funnel shape in FIG. 7, a concave funnel shape in FIG. 9, a divergently truncated shape in FIG. 8, and a convergently truncated shape in FIG. 10. Each one of these shapes, by its own specificity at tone level in particular contributes to improving the emissions of sounds of the flute.

What I claim is:

1. A flute having a cavity next to a mouthpiece hole, and an obturator for closing said cavity, said obturator defining a resonator chamber communicating with said cavity and including means for adjusting the size of said resonator chamber, to improve the emission of at least one particular note produced by the instrument.

2. An obturator for closing a cavity next to the mouthpiece hole of a transverse flute, said obturator defining a resonator chamber communicating with the said cavity and including means for adjusting the size of said resonator chamber, to improve the emission of at least one particular note produced by the instrument.

3. The obturator according to claim 2, including external adjustment means for adjusting the position of the obturator inside said instrument cavity, and wherein said means for adjusting the size of the resonator chamber are accessible externally of said instrument.

4. The obturator according to claim 2, wherein the obturator defines a chamber having a uniform cross-section along a first portion thereof, and a varying cross-section along a second portion thereof.

5. The obturator according to claim 4, wherein the chamber's second portion has a convex funnel shape.

6. The obturator according to claim 4, wherein the chamber's second portion has a concave funnel shape.

7. The obturator according to claim 4, wherein the chamber's second portion has a step-wise funnel shape.

8. The obturator according to claim 4, wherein the chamber's second portion has a divergently truncated shape.

9. The obturator according to claim 4, wherein the chamber's second portion has a convergently truncated shape.

10. The obturator according to claim 2, wherein the chamber has a tuning length and fundamental frequency which is a binary logarithm of the fundamental frequency of said particular note produced by the instrument.

11. The obturator according to claim 2, wherein at least two concentric chambers are provided.

12. The obturator according to claim 11, wherein means for adjusting the size of each resonator chamber are provided.

13. The obturator according to claim 2, wherein said obturator defines an alveolated surface having a plurality of chamber holes.

14. The obturator according to claim 13, including means for separately adjusting the length of each of the chamber holes.

15. The obturator according to claim 13, wherein the chamber holes are circular in cross-section.

16. The obturator according to claim 13, wherein the chamber holes are hexagonal in cross-section.

* * * * *